US012037761B2

(12) United States Patent
Seo et al.

(10) Patent No.: US 12,037,761 B2
(45) Date of Patent: Jul. 16, 2024

(54) STRUT CONNECTOR

(71) Applicants: HENCE CONSTRUCTION CO., LTD., Seoul (KR); Yun Yeong Seo, Seoul (KR); Gyeong Sik Seo, Seoul (KR)

(72) Inventors: Seung Kwon Seo, Seoul (KR); Yun Yeong Seo, Seoul (KR); Gyeong Sik Seo, Seoul (KR); Hun Woo Nam, Asan-si (KR)

(73) Assignees: Yun Yeong Seo, Seoul (KR); Gyeong Sik Seo, Seoul (KR); HENCE CONSTRUCTION CO., LTD., Seoul (KR)

( * ) Notice: Subject to any disclaimer, the term of this patent is extended or adjusted under 35 U.S.C. 154(b) by 199 days.

(21) Appl. No.: 17/607,589

(22) PCT Filed: May 13, 2019

(86) PCT No.: PCT/KR2019/005700
§ 371 (c)(1),
(2) Date: Apr. 6, 2023

(87) PCT Pub. No.: WO2020/226217
PCT Pub. Date: Nov. 12, 2020

(65) Prior Publication Data

US 2023/0235524 A1 Jul. 27, 2023

(30) Foreign Application Priority Data

May 3, 2019 (KR) ..... 10-2019-0051934

(51) Int. Cl.
*E04G 25/04* (2006.01)
*E02D 17/04* (2006.01)
*E02D 17/08* (2006.01)

(52) U.S. Cl.
CPC ..... *E02D 17/083* (2013.01); *E02D 17/04* (2013.01); *E02D 2600/20* (2013.01)

(58) Field of Classification Search
CPC ... E02D 17/083; E02D 17/04; E02D 2600/20; E02D 17/08; E02D 29/02
See application file for complete search history.

(56) References Cited

U.S. PATENT DOCUMENTS 3,362,167 A * 1/1968 Ward ..... E02D 17/083 405/282
3,530,679 A * 9/1970 Krings ..... E02D 17/083 405/282

(Continued)

FOREIGN PATENT DOCUMENTS

JP 2001-214543 A 8/2001
KR 10-2005-0075314 A 7/2005

(Continued)

*Primary Examiner* — Amy J. Sterling
(74) *Attorney, Agent, or Firm* — Bridgeway IP Law Group, PLLC; Jihun Kim

(57) ABSTRACT

A strut connector may include a connector base, a cover band, a cover band fixer for fixing the cover band to the connector base, and a connection jack. The connector base may include a base body; a support band protruding from one surface of the base body; a base reinforcement boss protruding from the one surface of the base body to a smaller height than the support band; a base connection boss protruding in the opposite direction of the protruding direction of the support band; a base through-hole formed through the base body, the base reinforcement boss and the base connection boss; and a base screw portion formed on the inside of the base through-hole. The cover band may be separably coupled to the connector base.

9 Claims, 15 Drawing Sheets

(56) References Cited

U.S. PATENT DOCUMENTS

| | | | | |
|---|---|---|---|---|
| 5,499,890 | A * | 3/1996 | Kishi | E02D 17/083 405/282 |
| 5,503,504 | A * | 4/1996 | Hess | E02D 17/08 405/282 |
| 5,741,091 | A * | 4/1998 | St. George | E02D 17/08 405/282 |
| 7,837,413 | B1 * | 11/2010 | Kundel, Sr. | E02D 17/08 248/644 |
| 10,132,427 | B1 * | 11/2018 | Park | F16L 1/09 |
| 10,501,957 | B1 * | 12/2019 | Borowiak | E04H 12/22 |
| 11,781,279 | B1 * | 10/2023 | Parr | E02D 5/526 405/251 |
| 2014/0248093 | A1 * | 9/2014 | Breen | E02F 5/10 405/284 |
| 2018/0209114 | A1 * | 7/2018 | Foley | E02D 17/083 |
| 2022/0010516 | A1 * | 1/2022 | Miller | E02D 5/526 |
| 2023/0235524 | A1 * | 7/2023 | Seo | E02D 29/02 248/354.1 |

FOREIGN PATENT DOCUMENTS

| | | | |
|---|---|---|---|
| KR | 10-0865068 | B1 | 10/2008 |
| KR | 2012-0120565 | A | 11/2012 |
| KR | 10-2013-0003689 | A | 1/2013 |
| KR | 10-2013-0062018 | A | 6/2013 |

* cited by examiner

STRUT CONNECTOR

TECHNICAL FIELD

The present invention relates to a strut connector, and more particularly, to a strut connector which is used to connect a strut for providing a supporting force to a wale of an earth retaining wall that is installed to support earth pressure during excavation work.

BACKGROUND ART

During excavation work for infrastructure construction of subways, buildings, underground roadways and underground storage facilities, earth retaining work for supporting earth pressure is conducted at the outer edges of an excavated site.

The earth retaining work is aimed at resisting lateral pressure such as earth pressure or water pressure, that occurs during underground excavation. Recently, however, as excavation work is frequently conducted in downtown sections, the earth retaining work has become available for various fields. For example, the earth retaining work is conducted to avoid the settlement of ground around downtown sections or to protect buildings therearound.

The earth retaining work is conducted together with the excavation work. Generally, during the earth retaining work, support columns such as H beams are erected perpendicular to the ground so as to be arranged at random intervals, and a plurality of earth retaining plates are stacked and inserted between the neighboring support columns, thereby forming an earth retaining wall for supporting an earth wall or rock wall. Then, wales are transversely connected to the support columns, and the facing wales are connected to each other through struts, which allows the earth retaining wall to resist the earth pressure.

The struts serve to effectively support the earth pressure applied to the earth retaining wall, thereby preventing the loss or collapse of earth and sand of the excavated earth wall. In general, the struts are arranged at constant intervals. A connection jack may be fastened to a connection portion between a wale and a strut, such that the length of the strut can be adjusted. In conventional practices, an H beam is mainly used as the strut. However, since the H beam is easily bucked and has a heavy weight, the use of a steel pipe-shaped strut has recently increased.

The steel pipe-shaped strut has a circular cross section. Thus, in order to connect the steel pipe-shaped strut to a wale or to connect two steel pipe-shaped struts to each other, a connector is needed for maintaining a stable coupling state with an end of the steel pipe-shaped strut.

For example, Korean Patent Application Laid-Open No. 2012-0120565 discloses a strut connection structure which connects ends of two struts facing each other. According to the strut connection structure disclosed in the above-described document, a pair of steel pipe connection members coupled to the front ends of two steel pipes, respectively, are coupled to the respective steel pipes through bolts and nuts, and also fixed to each other by bolts and nuts.

However, the conventional strut connection structure requires a number of bolts and nuts to couple the pair of steel pipe connection members to each other or to fix the steel pipe connection members to the respective steel pipes, which causes many inconveniences during work and extends the work time.

DISCLOSURE

Technical Problem

The present invention has been made in view of the above-mentioned problems occurring in the related art, and it is an object of the present invention to provide a strut connector which can facilitate a strut connection operation, shorten the work time, and more stably support a strut.

Technical Solution

According to an aspect of the present invention, there is provided a strut connector which is coupled to an end of a strut for supporting a wale coupled to an earth retaining wall, and connects the wale and the strut. The strut connector may include: a connector base including a base body; a support band having a support band arc portion corresponding to the outer circumferential surface of the strut so as to support an end periphery of the strut, and provided at an edge of the base body so as to protrude from one surface of the base body; a base reinforcement boss provided on a central portion of the base body so as to protrude from the one surface of the base body to a smaller height than the support band; a base connection boss protruding from the other surface of the base body in the opposite direction of the protruding direction of the support band; a base through-hole formed through the base body, the base reinforcement boss and the base connection boss; and a base screw portion formed on the inside of the base through-hole; a cover band including a cover band body having a cover band arc portion corresponding to the outer circumferential surface of the strut, and separably coupled to the connector base such that the cover band body covers the outer circumferential surface of the strut placed on the support band; a cover band fixer configured to fix the cover band to the connector base; and a connection jack including: a connection jack body having a connection jack bracket coupled to the wale and a connection jack boss protruding from one surface of the connection jack bracket; a connection jack body coupling hole formed in the connection jack boss; a connection jack body screw portion formed on the inside of the connection jack body coupling hole; a connection jack screw screwed to the base screw portion and the connection jack body screw portion and configured to connect the connector base and the connection jack body such that the distance therebetween is adjustable, and a connection jack lever provided on one side of the connection jack screw so as to protrude to the outside. The connection jack screw may be able to enter the strut placed on the support band through the base through-hole.

The connector base may include a plurality of base inner reinforcement ribs protruding from the one surface of the base body and radially arranged on the circumference of the base reinforcement boss.

The base inner reinforcement rib may have a length which is set to such an extent that an end thereof abuts on the inner circumferential surface of the strut placed on the support band.

The base inner reinforcement rib may include an inclined portion which is provided at the end periphery thereof and formed in such a shape that the protruding height thereof from the one surface of the base body decreases in a direction away from the base reinforcement boss.

The plurality of base inner reinforcement ribs may be arranged at regular angle intervals along the circumference of the base reinforcement boss.

The connection jack bracket may include a plurality of connection jack body through-holes into which a plurality of fixing members fixed to the wale are inserted, and have a length corresponding to the top-to-bottom length of a wale assembly so as to be fixed to the wale assembly in which two wales are connected in parallel to each other in a top-to-bottom direction by the plurality of fixing members while abutting on each other.

The support band may include a plurality of support band through-holes corresponding to a plurality of strut coupling holes which are arranged on the outer circumferential surface of the strut so as to be spaced apart from each other in a radial direction of the strut, and the cover band body may include a plurality of cover band through-holes corresponding to the plurality of strut coupling holes. The strut connector may include a plurality of fastening members each inserted into the corresponding strut coupling hole, the corresponding support band through-hole and the corresponding cover band through-hole so as to fasten the strut to the connector base and the cover band.

The cover band through-holes may be formed in a long groove shape extended in one direction, and at least one of the cover band through-holes may be extended in a direction crossing the direction in which another of the cover band through-holes is extended. The support band through-holes may be formed in a long groove shape extended in one direction so as to correspond to the respective cover band through-holes, and at least one of the support band through-holes may be extended in a direction crossing the direction in which another of the support band through-holes is extended.

The cover band may include a plurality of cover band reinforcement ribs and one cover band center reinforcement rib, which protrude from the outer surface of the cover band body. The plurality of cover band reinforcement ribs and the cover band center reinforcement rib may be arranged along the outer circumferential surface of the cover band body so as to spaced apart from each other, the cover band center reinforcement rib may be located in the center of the cover band body, and the plurality of cover band reinforcement ribs may be symmetrically arranged with respect to the cover band center reinforcement rib.

Advantageous Effects

According to the embodiment of the present invention, the strut connector may stably connect a strut to a wale, and easily adjust the distance between the strut and the wale.

Furthermore, the strut connector may be easily coupled to the strut, and easily handled by an operator, and shorten the work time required for connecting the strut.

Moreover, the strut connector may have high resistance to deformation attributable to a load, and exhibit excellent strength, thereby reliably supporting the strut.

Furthermore, the strut connector may support the strut to be located perpendicular to the wale, thereby increasing the supporting force of the strut.

MODE FOR INVENTION

Hereafter, a strut connector according to the present invention will be described in detail with reference to the accompanying drawings.

Figure 1:
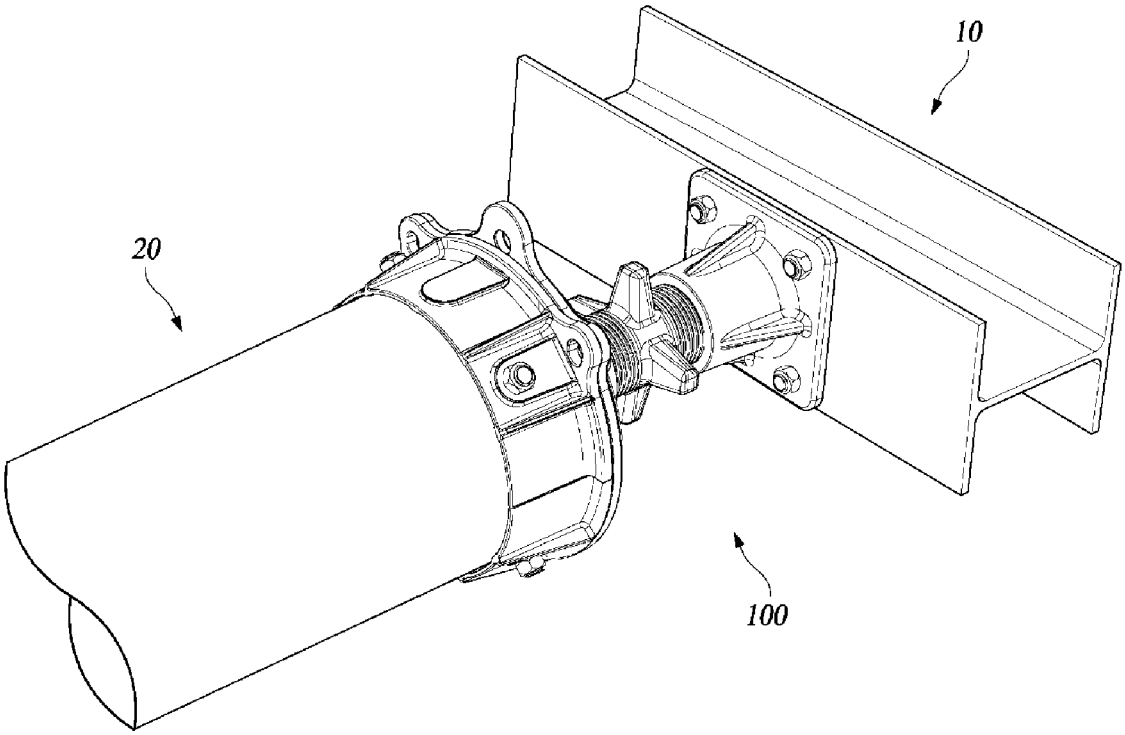
FIG. 1 is a perspective view illustrating an installation state of a strut connector according to an embodiment of the present invention.
Figure 2:
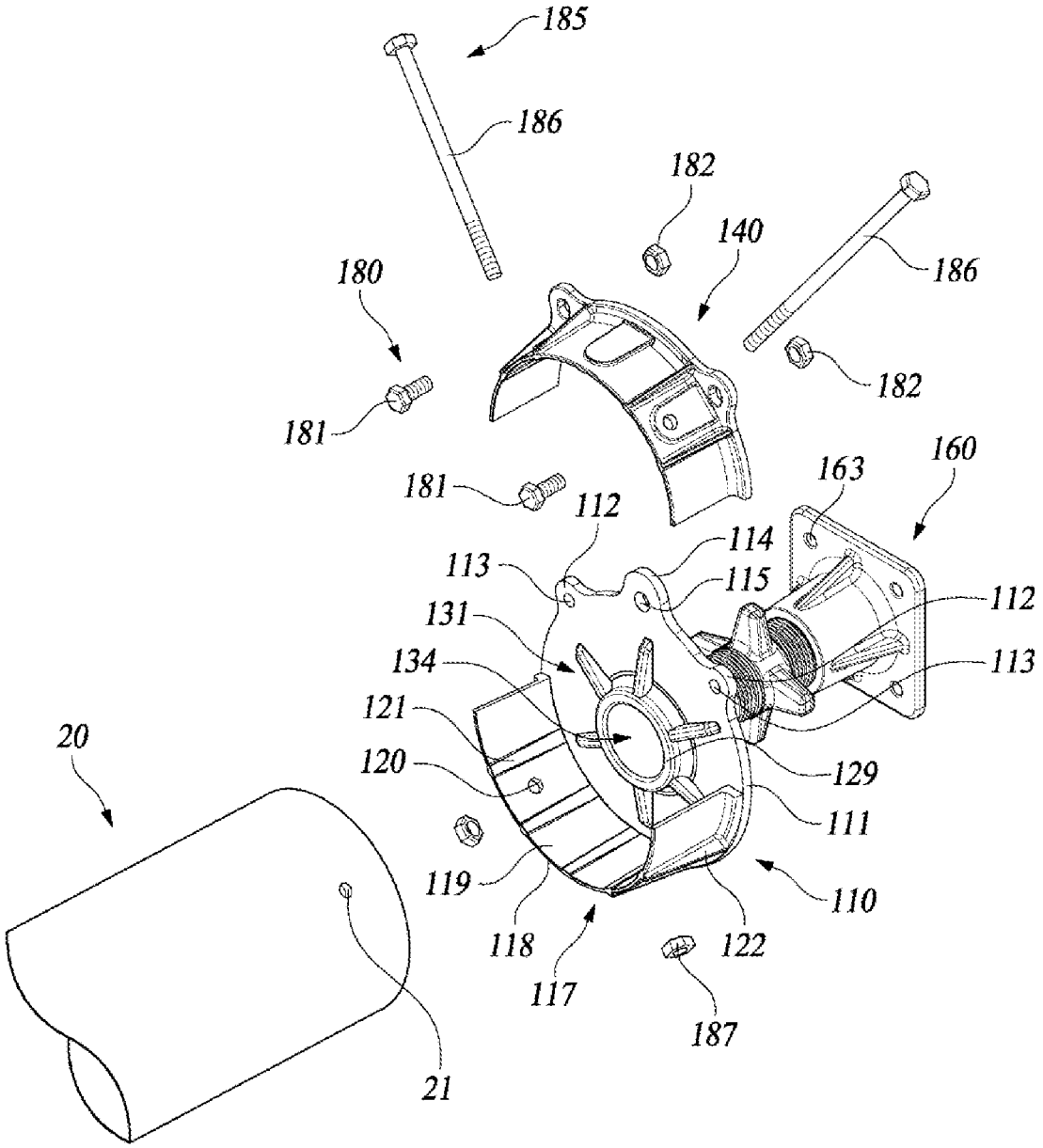
FIG. 2 is a partially exploded view of the strut connector according to the embodiment of the present invention.
Figure 3:
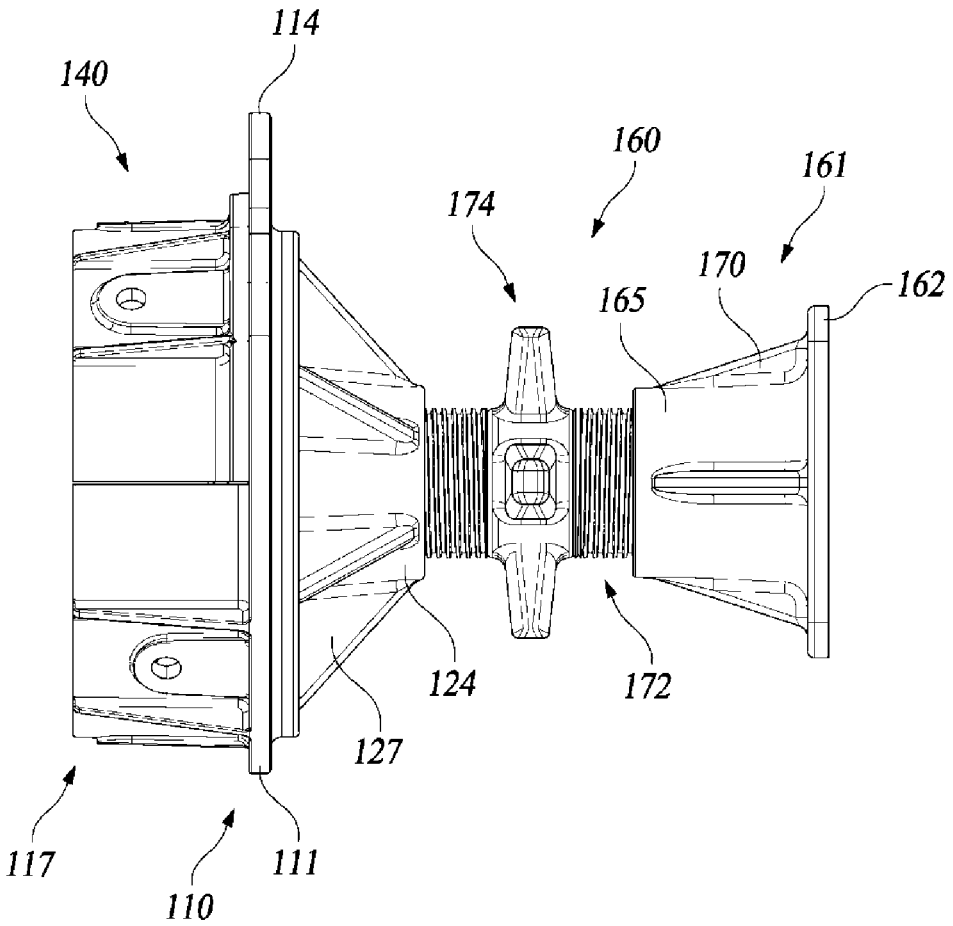
FIG. 3 is a side view illustrating the strut connector according to the embodiment of the present invention.
Figure 4:
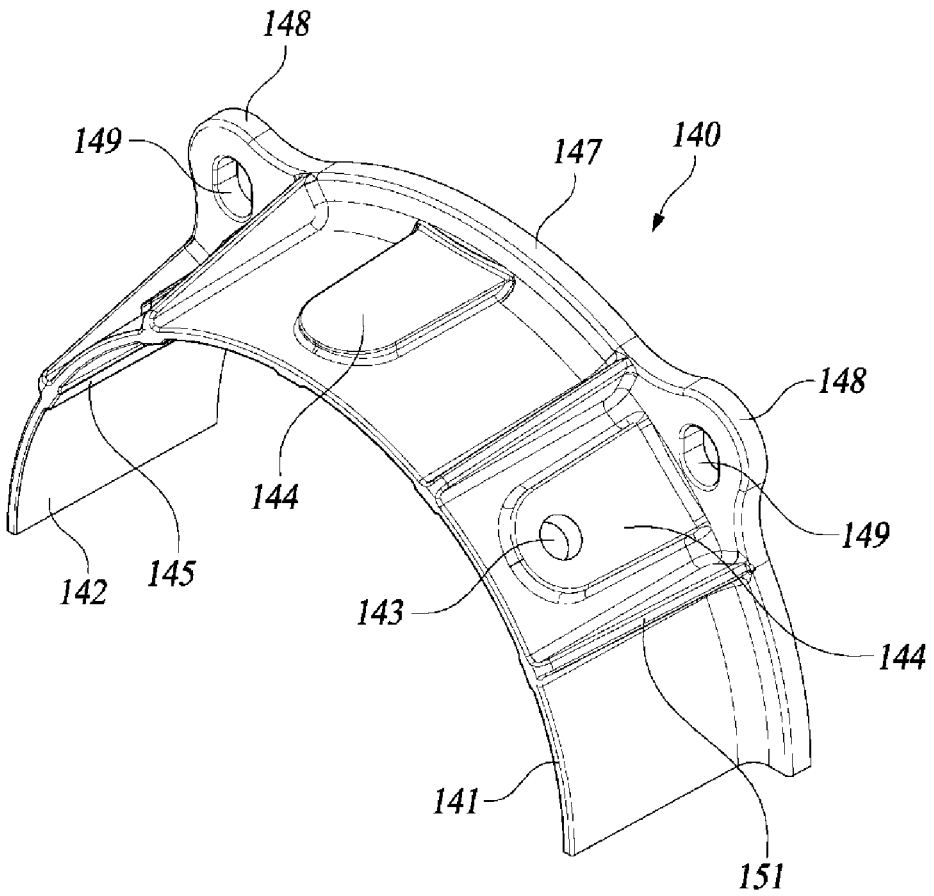
FIGS. 4 and 5 are perspective views illustrating a cover band of the strut connector according to the embodiment of the present invention.
Figure 5:
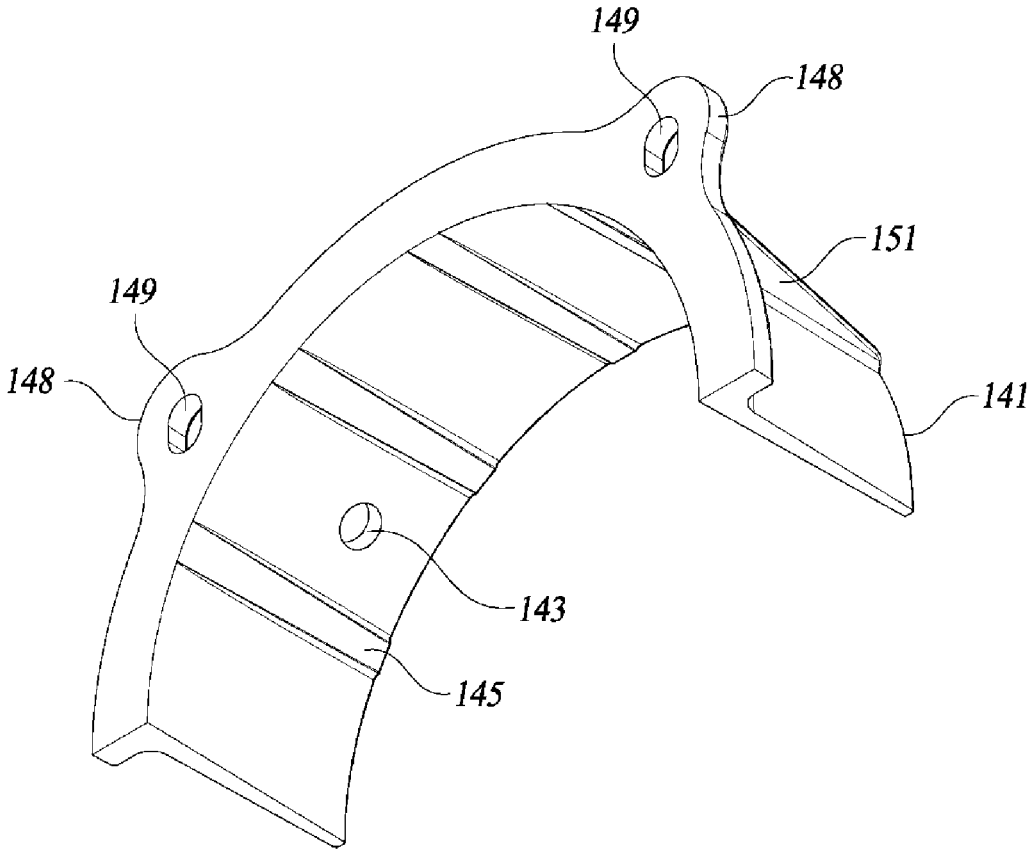

FIG. 1 is a perspective view illustrating an installation state of a strut connector according to an embodiment of the present invention, FIG. 2 is a partially exploded view of the strut connector according to the embodiment of the present invention, FIG. 3 is a side view illustrating the strut connector according to the embodiment of the present invention, and FIGS. 4 and 5 are perspective views illustrating a cover band of the strut connector according to the embodiment of the present invention.

As illustrated in the drawings, a strut connector 100 according to the embodiment of the present invention is coupled to an end of a strut 20 for supporting a wale 10 coupled to an earth retaining wall, and serves to connect the wale 10 and the strut 20. The strut connector 100 includes a connector base 110, a cover band 140, a strut fastener 185 and a connection jack 160. The connector base 110 is coupled to the end of the strut 20, the cover band 140 is coupled to the connector base 110 so as to fix the end of the strut 20 along with the connector base 110, the strut fastener 185 serves to fasten the connector base 110 and the cover band 140 to the strut 20, and the connection jack 160 is coupled to the connector base 110 so as to adjust the distance between the wale 10 and the connector base 110.

The connector base 110 includes a base body 111, a support band 117 provided at the bottom edge of the base body 111 so as to protrude from one surface of the base body 111, a base connection boss 124 protruding from the other surface of the base body 111, a base reinforcement boss 129 protruding from the one surface of the base body 111 to a smaller protruding height than the support band 117, and a base through-hole 134. The base through-hole 134 is formed through the base body 111, the base connection boss 124 and the base reinforcement boss 129.

The base body 111 has one flat surface. The end of the strut 20 may be brought into close contact with the one surface of the base body 111. The base body 111 has a pair of base body protrusions 112 and a base body center protrusion 114, which are formed at one edge thereof so as to protrude to the outside of the base body 111. The pair of base body protrusions 112 are symmetrically located on both sides of the base body center protrusion 114, and the base body center protrusion 114 is located midway between the pair of base body protrusions 112. The base body protrusion 112 has a base coupling hole 113. The base coupling hole 113 is formed through the base body protrusion 112. A cover band fixing member 181 of a cover band fixer 180 for coupling the connector base 110 and the cover band 140 may be inserted into the base coupling hole 113. The base body center protrusion 114 has a connection hole 115 formed therein. A connector such as a rope or wire, connected to equipment such as a crane which can carry the strut connector 100, may be connected to the connection hole 115. The connector base 110 is coupled to the wale 10 such that the base body center protrusion 114 faces upward.

The support band 117 is provided at the edge of the base body 111 so as to protrude from the one surface of the base body 111. The support band 117 includes a support band body 118 having a support band arc portion 119. The support band arc portion 119 has an arc shape corresponding to the outer circumferential surface of the strut 20, and is provided on the inside of the support band body 118. The support band arc portion 119 may support the end periphery of the strut 20 while partially covering the outer circumferential surface of the strut 20. The support band arc portion 119 has a plurality of support band through-holes 120. The support band through-holes 120 are formed to correspond to a plurality of strut coupling holes 21 formed in the strut 20, respectively.

Figure 6:
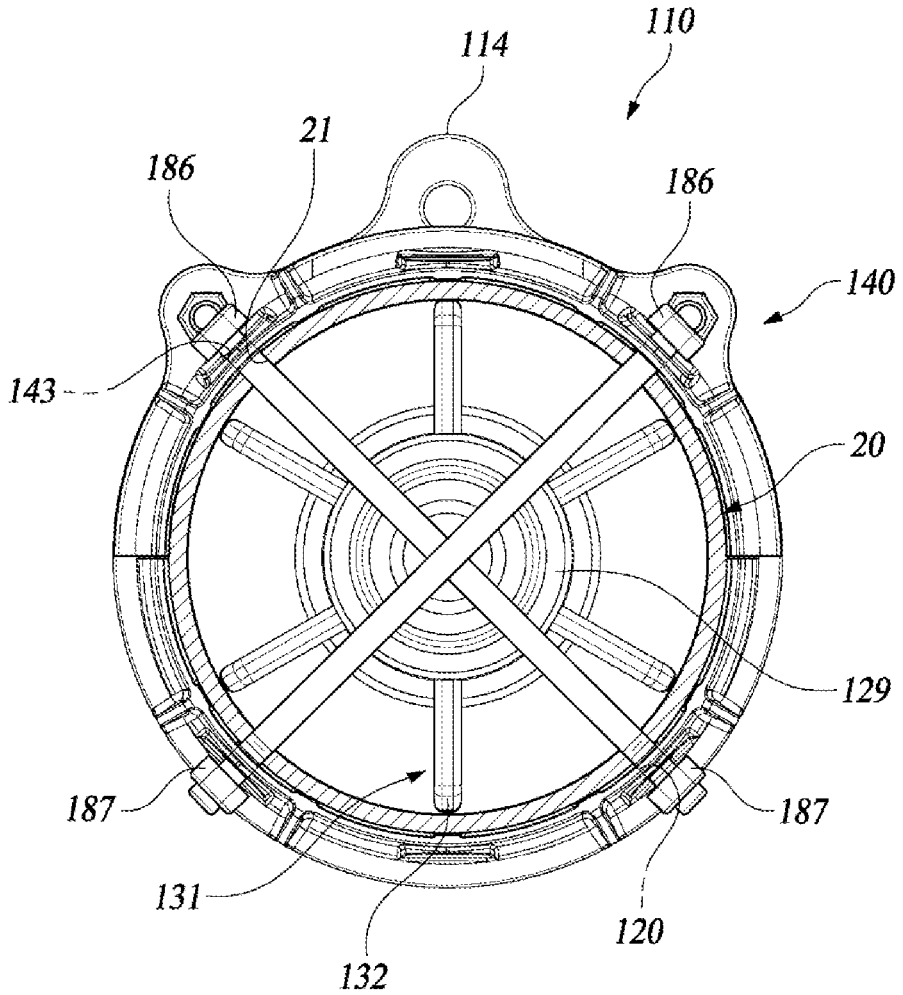
FIG. 6 is a front view illustrating that a strut is coupled to the strut connector according to the embodiment of the present invention.

As illustrated in FIG. 6, the strut coupling holes 21 of the strut 20 are formed at the end periphery of the strut 20 in the radial direction of the strut 20, i.e. the direction from the outer circumferential surface of the strut 20 toward the central axis of the strut 20. The plurality of strut coupling holes 21 are located on the outer circumferential surface of the strut 20, such that each two strut coupling holes 21 facing each other make a pair. That is, the two strut coupling holes 21 making a pair are placed on a straight line, and a fastening member 186 of the strut fastener 185 may be inserted into the two strut coupling holes 21 making a pair. In the present embodiment, the case in which four strut coupling holes 21 making two pairs are formed in the strut 20 will be taken as an example for description.

The two support band through-holes 120 are formed in the support band body 118 so as to be spaced apart from each other, and located to correspond to the two strut coupling holes 21 located at a relatively low level among the four strut coupling holes 21 formed in the strut 20. When the end periphery of the strut 20 is placed on the support band body 118, the support band through-holes 120 face the corresponding strut coupling holes 21. Therefore, the fastening member 186 may be inserted into the strut coupling hole 21 through the support band through-hole 120, or the fastening member 186 inserted into the strut 20 may enter the support band through-hole 120 through the strut coupling hole 21.

The support band arc portion 119 of the support band 117 has a plurality of support band pressurizing protrusions 121. The support band pressurizing protrusions 121 protrude from the support band arc portion 119, and are arranged at regular intervals in the circumferential direction of the support band arc portion 119. When the strut 20 is placed on the support band body 118, the plurality of support band pressurizing protrusions 121 arranged at regular intervals may come into close contact with the outer circumferential surface of the strut 20, thereby more stably seating the strut 20 on the support band 117, and increasing the coupling force between the support band 117 and the strut 20. The specific structure or number of the support band pressurizing protrusions 121 and the arrangement interval therebetween may be changed in various manners.

The support band body 118 has a plurality of support band reinforcement ribs 122 located on the outer surface thereof and spaced apart from each other along the outer circumferential surface thereof. The support band reinforcement ribs 122 may protrude from the support band body 118 so as to be connected to the base body 111, thereby increasing the entire strength of the support band 117 and the connector base 110. By using the support band reinforcement ribs 122, it is possible to maintain the strength of the support band 117, while reducing the thickness of the support band 117. As a result, it is possible to reduce the material cost and weight of the strut connector. The number or shape of the support band reinforcement ribs 122 is not limited to that illustrated in the drawings, but may be changed in various manners.

The base connection boss 124 is provided on the other surface of the base body 111 so as to protrude in the opposite direction of the protruding direction of the support band 117. The base connection boss 124 has a cylindrical shape. The base connection boss 124 has a base screw portion 125 formed on the inside thereof, the base screw portion 125 including a plurality of female screw threads. A connection jack screw 172 of the connection jack 160 may be screwed to the base screw portion 125. The base connection boss 124 has a plurality of base outer reinforcement ribs 127 arranged along the outer circumference thereof. The base outer reinforcement ribs 127 may be arranged along the circumference of the base connection boss 124 so as to connect the base body 111 and the base connection boss 124, thereby increasing the entire strength of the connector base 110.

The base reinforcement boss 129 is formed at the central portion of the base body 111, and protrudes from one surface of the base body 111 to a smaller protruding height than the support band 117. The base reinforcement boss 129 is formed in a ring shape to surround the base through-hole 134, and serves to increase the strength of the base body 111. That is, as the base through-hole 134 is formed in the base body 111, the strength of the base body 111 may be reduced. In this case, however, the base reinforcement boss 129 may make up for the reduction in strength of the base body 111.

The base reinforcement boss 129 has a plurality of base inner reinforcement ribs 131 arranged on the circumference thereof. The plurality of base inner reinforcement ribs 131 are radially arranged along the circumference of the base reinforcement boss 129, and protrude from the one surface of the base body 111 to a smaller protruding height than the base reinforcement boss 129. The base inner reinforcement ribs 131 serve to increase the strength of the base body 111. The plurality of base inner reinforcement ribs 131 may be arranged at regular angle intervals along the circumference of the base reinforcement boss 129, thereby increasing the entire strength of the base body 111.

Furthermore, the base inner reinforcement ribs 131 may increase the coupling force between the connector base 110 and the strut 20, thereby more stably supporting the strut 20.

Figure 7:
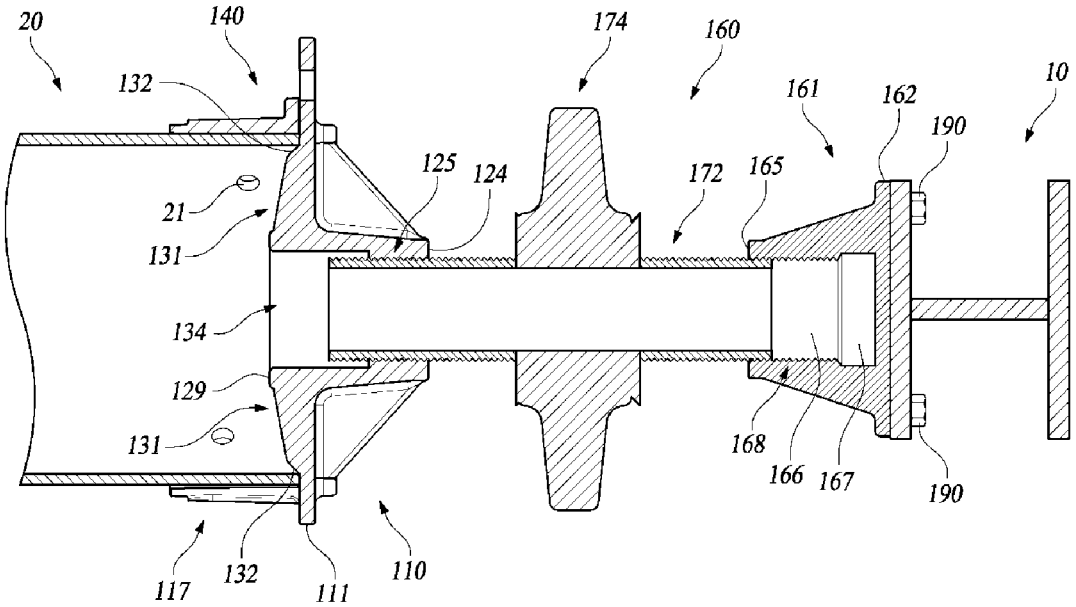
FIGS. 7 and 8 are diagrams for describing a method for adjusting the distance between a wale and the strut through the strut connector according to the embodiment of the present invention.

For this structure, the base inner reinforcement rib 131 has a length which is set to such an extent that the end thereof can abut on the inner circumferential surface of the strut 20 placed on the support band 117. As illustrated in FIGS. 6 and 7, when the strut 20 is placed on the support band 117 such that the end thereof comes into contact with the one surface of the base body 111, the respective ends of the plurality of base inner reinforcement ribs 131 may abut on the inner circumferential surface of the strut 20. Thus, the strut 20 may not move or shake, but maintain a stable fixed state on the support band 117.

Furthermore, as the plurality of base inner reinforcement ribs 131 are arranged along the inner circumference of the strut 20 so as to abut on the inner circumferential surface of the strut 20, a vertical load applied to the strut 20 may be dispersed so as not to be concentrated on a part of the strut 20. Therefore, it is possible to prevent damage to the strut 20, while more stably maintaining the coupling state between the strut 20 and the strut connector 100.

Furthermore, the plurality of base inner reinforcement ribs 131 serve to align the position of the strut 20 during a process of connecting the strut 20 to the strut connector 100. That is, when the strut 20 is placed on the support band 117 such that the end thereof faces the one surface of the base body 111, the plurality of base inner reinforcement ribs 131 enter the strut 20 and come into contact with the inner circumferential surface of the strut 20 in top-to-bottom and side-to-side directions. Thus, the strut 20 may not be tilted in a specific direction, but be aligned so that the center thereof is matched with the center of the base reinforcement boss 129 and placed on a straight line with the strut connector 100. Therefore, the strut 20 may be coupled to the strut connector 100 so as to be more smoothly placed perpendicular to the wale 10.

The base inner reinforcement rib 131 has an inclined portion 132 formed at the end periphery thereof. The inclined portion 132 is formed in such a shape that the protruding height from the one surface of the base body 111 decreases in a direction away from the base reinforcement boss 129. Furthermore, the inclined portion 132 is formed at the end of the base inner reinforcement rib 131 so as to be inclined downward along a gentle curve. When the strut 20 is coupled to the strut connector 100, the end of the strut 20 may be brought into contact with the inclined portion 132, and the inclined portion 132 may guide the strut 20 such that the inner circumferential surface of the strut 20 is located outside the base inner reinforcement ribs 131. That is, when the strut 20 is placed on the support band 117 while the center thereof is not matched with the center of the base reinforcement boss 129, a part of the end of the strut 20 may be brought into contact with the inclined portion 132 of the base inner reinforcement rib 131. In this state, when the strut 20 is pressurized toward the base body 111, the strut 20 is moved in the longitudinal direction of the base inner reinforcement rib 131 along the inclined portion 132 with which the end thereof is brought into contact. Thus, the strut 20 may be aligned so that the center thereof coincides with the center of the base reinforcement boss 129, and coupled to the connector base 110 such that the plurality of base inner reinforcement ribs 131 are located inside the end periphery of the strut 20.

Figure 9:
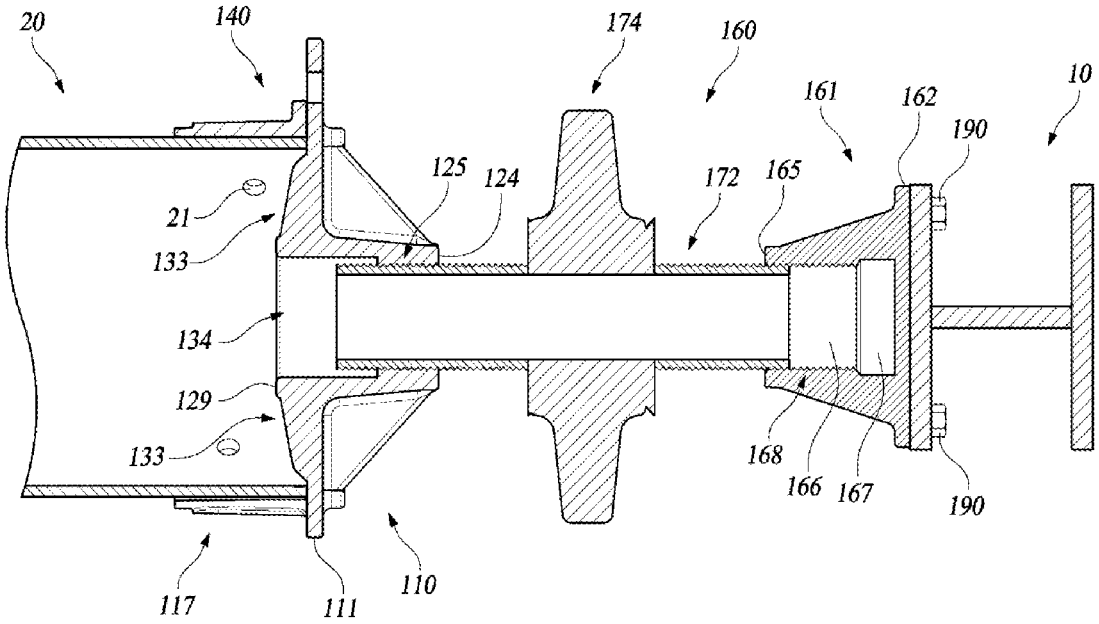
FIG. 9 is a cross-sectional view illustrating an installation state of a strut connector according to another embodiment of the present invention.

FIG. 6 illustrates that six base inner reinforcement ribs 131 are arranged at angle intervals of 60 degrees on the circumference of the base reinforcement boss 129. However, the number of the base inner reinforcement ribs 131 or the arrangement angle therebetween may be changed in various manners. Furthermore, FIG. 6 illustrates that the base inner reinforcement rib 131 has a length which is set to such an extent that the end thereof abuts on the inner circumferential surface of the strut 20 placed on the support band 117. As illustrated in FIG. 9, however, a base inner reinforcement rib 133 may have a length which is set to such an extent that the end thereof does not come into contact with the inner circumferential surface of the strut 20. Furthermore, in addition to the illustrated structure, the base inner reinforcement ribs 131 may be changed to various structures, as long as the base inner reinforcement ribs 131 are arranged along the circumference of the base reinforcement boss 129 and can increase the strength of the base body 111.

As illustrated in FIGS. 1 to 6, the cover band 140 is separably coupled to the connector base 110 so as to cover a part of the outer circumferential surface of the strut 20 coupled to the connector base 110. The cover band 140 includes a cover band body 141 having a cover band arc portion 142 corresponding to the outer circumferential surface of the strut 20.

The cover band arc portion 142 is formed in an arc shape corresponding to the outer circumferential surface of the strut 20, and located on the inside of the cover band body 141. The cover band arc portion 142 may cover the end periphery of the strut 20 while partially covering the outer circumferential surface of the strut 20. The cover band arc portion 142 has a plurality of cover band through-holes 143. The cover band through-holes 143 are formed to correspond to the strut coupling holes 21 formed in the strut 20. The cover band body 141 has a plurality of cover band thickness reinforcement parts 144 protruding from the outer surface thereof, and the cover band through-holes 143 are located at the respective cover band thickness reinforcement parts 144. As the cover band through-holes 143 are formed in the cover band body 141, the strength of the cover band body 141 may be reduced. In this case, however, the cover band thickness reinforcement parts 144 may make up for the reduction in strength of the cover band body 141.

The cover band body 141 has two cover band through-holes 143 which are spaced apart from each other so as to correspond to two strut coupling holes 21 located at a relatively high level among the four strut coupling holes 21 formed in the strut 20. When the cover band 140 is coupled to the end periphery of the strut 20, each of the cover band through-holes 143 faces the corresponding strut coupling hole 21. Therefore, the fastening member 186 may be inserted into the strut coupling hole 21 through the cover band through-hole 143, or the fastening member 186 inserted into the strut 20 may enter the cover band through-hole 143 through the strut coupling hole 21.

The cover band arc portion 142 of the cover band 140 has a plurality of cover band pressurizing protrusions 145. The cover band pressurizing protrusions 145 protrude from the cover band arc portion 142, and are arranged at regular intervals in the circumferential direction of the cover band arc portion 142. When the cover band 40 is coupled to the connector base 110, the plurality of cover band pressurizing protrusions 145 arranged at regular intervals may be brought into close contact with the outer circumferential surface of the strut 20, thereby more stably fixing the strut 20 to the connector base 110, and increasing the coupling force between the cover band 140 and the strut 20. The specific structure or number of the cover band pressurizing protrusions 145 and the arrangement interval therebetween may be changed in various manners.

The cover band body 141 has a cover band flange 147 provided at the edge thereof and protruding from the outer surface thereof. Furthermore, the cover band flange 147 has a pair of cover band flange protrusions 148 provided at the outer edge thereof and protruding to the outside. The cover band flange protrusions 148 each have a cover band coupling hole 149 formed therein. The cover band coupling hole 149 is formed to correspond to the base coupling hole 113 of the connector base 110. The cover band fixing member 181 of the cover band fixer 180 may be inserted into the cover band coupling hole 149.

The cover band coupling hole 149 is formed in a long groove shape extended in one direction, and has a larger size than the base coupling hole 113. As such, when the size of the cover band coupling hole 149 is larger than the size of the base coupling hole 113, the base coupling hole 113 and the cover band coupling hole 149 may be easily matched by adjusting the position of the cover band 140 in case that the cover band 140 is coupled to the connector base 110. After the strut 20 is placed on the support band 117, the cover band 140 may be coupled to the connector base 110 while covering the strut 20 from above the strut 20. Therefore, desirably, the cover band coupling hole 149 may be extended in the direction that the cover band 140 covers the strut 20.

The cover band body 141 has a plurality of cover band reinforcement ribs 151 arranged on the outer surface thereof and spaced apart from each other along the outer circumferential surface thereof. The cover band reinforcement ribs 151 may protrude from the cover band body 141 so as to be connected to the cover band flange 147, thereby increasing the entire strength of the cover band body 141 and the cover band 140. By using the cover band reinforcement ribs 151, it is possible to maintain the strength of the cover band 140, while reducing the thickness of the cover band 140. As a result, it is possible to reduce the material cost and weight of the strut connector. The number or shape of the cover band reinforcement ribs 151 is not limited to that illustrated in the drawings, but may be changed in various manners.

Such a cover band 140 may be fixed to the connector base 110 by the cover band fixer 180, while covering then end periphery of the strut 20. The cover band fixer 180 includes the cover band fixing member 181 and a cover band fixing nut 182 screwed to the cover band fixing member 181. The cover band 140 may be firmly fixed to the connector base 110 through a method of inserting the cover band fixing member 181 into the base coupling hole 113 of the connector base 110 and the cover band coupling hole 149 of the cover band 140, with the cover band 140 covering the strut 20 coupled to the connector base 110, and then screwing the cover band fixing nut 182 to the cover band fixing member 181.

The coupling structure between the connector base 110 and the cover band 140 may be changed in various manners. For another example, the structure of the connector base 110 may be modified so that the base coupling hole 113 is formed in the support band 117, and the position of the cover band coupling hole 149 of the cover band 140 may also be changed. Furthermore, depending on the coupling method between the connector base 110 and the cover band 140, the base coupling hole 113 of the connector base 110 or the cover band coupling hole 149 of the cover band 140 may be omitted. Moreover, the cover band fixer 180 may be changed to a structure other than the structure including the cover band fixing member 181 and the cover band fixing nut 182.

Referring to FIGS. 1 to 3 and 7, the connection jack 160 is fixed to the wale 10 and connects the connector base 110 to the wale 10 such that the distance therebetween is adjustable. The connection jack 160 includes a connection jack body 161 coupled to the wale 10 and the connection jack screw 172 screwed to the connector base 110 and the connection jack body 161.

The connection jack body 161 includes a connection jack bracket 162 fixed to the wale 10 and a connection jack boss 165 protruding from one surface of the connection jack bracket 162. The connection jack bracket 162 has a plurality of connection jack body through-holes 163. A fixing member 190 for fixing the connection jack body 161 may be inserted into each of the connection jack body through-holes 163. The connection jack body 161 may be fixed to the wale 10 through a method of coupling the fixing member 190 to the wale 10 through the connection jack body through-hole 163. The connection jack boss 165 has a connection jack body coupling hole 166 and a connection jack body inner groove 167, which are formed therein. The connection jack body coupling hole 166 is open to the outside from the end periphery of the connection jack boss 165 such that the connection jack screw 172 can be inserted into the connection jack body coupling hole 166, and the connection jack body inner groove 167 is extended from the connection jack body coupling hole 166 toward the connection jack bracket 162. The connection jack body coupling hole 166 has a connection jack body screw portion 168 formed on the inside thereof and including a plurality of female screw threads to which the connection jack screw 172 can be screwed.

The connection jack bracket 162 has a plurality of connection jack body reinforcement ribs 170 arranged on one surface thereof and spaced apart from each other along the outer circumferential surface of the connection jack boss 165. The connection jack body reinforcement ribs 170 may protrude from the connection jack bracket 162 so as to be connected to the connection jack boss 165, thereby increasing the entire strength of the connection jack body 161.

The connection jack screw 172 has one end inserted into the connection jack body 161 through the connection jack body coupling hole 166 and the other end inserted into the connector base 110 through the base through-hole 134. The connection jack screw 172 is screwed to the base screw portion 125 of the connector base 110 and the connection jack body screw portion 168 of the connection jack body 161, and connects the connector base 110 and the connection jack body 161 such that the distance therebetween is adjustable. The connection jack screw 172 has a connection jack lever 174 provided in the middle thereof. The connection jack lever 174 protrudes from the outer circumferential surface of the connection jack screw 172. An operator may rotate the connection jack screw 172 by using the connection jack lever 174.

When the operator rotates the connection jack screw 172 of the connection jack 160, screwed to the connection jack body 161 and the connector base 110, the connection jack screw 172 performs a screw motion with the connection jack body 161 and the connector base 110. As the distance between the connection jack body 161 and the connector base 110 is adjusted through such a screw motion, the distance between the wale 10 and the connector base 110 may be adjusted.

As described above, the strut connector 100 according to the embodiment of the present invention may be coupled to the end of the strut 20, and connect the strut 20 to the wale 10. In order to connect the strut 20 to the wale 10, first, the connection jack 160 coupled to the connector base 110 is firmly fixed to one side of the wale 10. At this time, the connector base 110 is located substantially perpendicular to the wale 10. Then, the end of the strut 20 is placed on the support band 117 of the connector base 110, and the support band 117 supports the strut 20 while covering approximately a half of the outer circumferential surface of the strut 20. When the strut 20 is pushed toward the base body 111 with the strut 20 supported by the support band 117, the plurality of base inner reinforcement ribs 131 enter the strut 20. At this time, the plurality of base inner reinforcement ribs 131 come into contact with the inner circumferential surface of the strut 20 in the top-to-bottom and side-to-side directions, and align the strut 20 such that the center of the strut 20 coincides with the center of the base reinforcement boss 129 of the connector base 110. Therefore, the strut 20 is located perpendicular to the wale 10.

Then, the cover band 140 is coupled to the connector base 110 so as to cover the other half of the outer circumferential surface of the strut 20. After the cover band 140 covers the strut 20, the cover band 140 is firmly fixed to the connector base 110 by the cover band fixer 180. Then, the fastening nut 187 may be screwed to the fastening member 186 of the strut fastener 185, with the fastening member 186 inserted into the support band through-hole 120 of the support band 117, the cover band through-hole 143 of the cover band 140, and the strut coupling hole 21 of the strut 20, which makes it possible to firmly fasten the strut 20, the connector base 110 and the cover band 140 to one another. As the pair of fastening members 186 are coupled to the connector base 110, the cover band 140 and the strut 20 so as to cross each other at a right angle, the connector base 110, the cover band 140 and the strut 20 may be more reliably fastened.

As such, the strut connector 100 coupled to the strut 20 may stably connect the strut 20 to the wale 10 or the like.

Furthermore, if necessary, the connection jack screw 172 of the connection jack 160 may be manipulated, in order to adjust the distance between the wale 10 and the strut 20.

For example, when the distance between the wale 10 and the strut 20 needs to be adjusted to a relatively long distance, the connection jack screw 172 may be turned to decrease the depth to which the connection jack screw 172 is inserted into the connector base 110 and the depth to which the connection jack screw 172 is inserted into the connection jack body 161, as illustrated in FIG. 7. Then, the distance between the connection jack body 161 and the connector base 110 may be increased.

Figure 8:
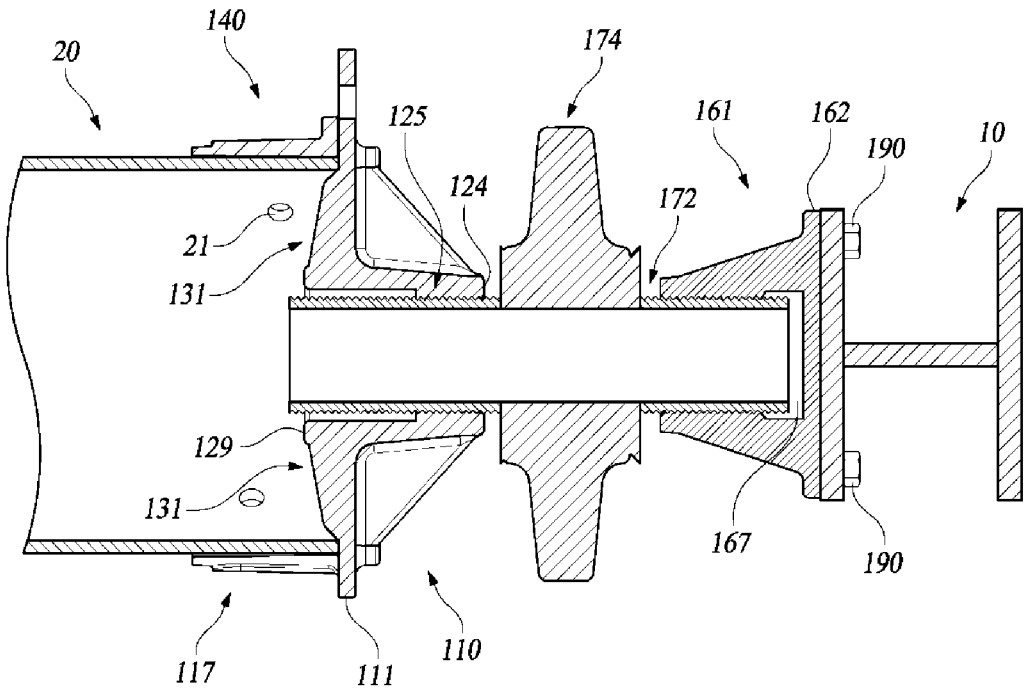

On the other hand, when the distance between the wale 10 and the strut 20 needs to be adjusted to a relatively short distance, the connection jack screw 172 may be turned to increase the depth to which the connection jack screw 172 is inserted into the connector base 110 and the depth to which the connection jack screw 172 is inserted into the connection jack body 161, as illustrated in FIG. 8. Then, the distance between the connection jack body 161 and the connector base 110 may be decreased.

When the distance between the connection jack body 161 and the connector base 110 is decreased, one end of the connection jack screw 172 may enter the connection jack body inner groove 167 of the connection jack body 161, and the other end of the connection jack screw 172 may enter the strut 20 placed on the support band 117 through the base through-hole 134 of the connector base 110. As such, the connection jack body inner groove 167 connected to the connection jack body coupling hole 166 may be provided in the connection jack 160 so as to insert the connection jack screw 172 into the connection jack 160, and the base through-hole 134, which is provided in the connector base 110 so as to insert the connection jack screw 172 into the connector base 110, may be formed through the base body 111, which makes it possible to increase the moving distance of the connection jack screw 172 through the screw motion. Furthermore, the increase in moving distance of the connection jack screw 172 may increase the adjustable distance between the connection jack body 161 and the connector base 110.

As described above, the strut connector 100 according to the embodiment of the present invention may stably connect the strut 20 to the wale 10, and easily adjust the distance between the strut 20 and the wale 10.

Moreover, the strut connector 100 according to the present invention may be easily coupled to the strut 20 and easily handled by an operator, and shorten the work time required for connecting the strut 20.

Furthermore, the strut connector 100 according to the present invention may have high resistance to deformation attributable to a load and exhibit excellent strength, thereby reliably supporting the strut 20.

Moreover, the strut connector 100 according to the present invention may support the strut 20 to be located perpendicular to the wale 10, thereby increasing the support force of the strut 20.

FIGS. 10 to 16 illustrate various modified examples of the strut connector according to the present invention.

Figure 10:
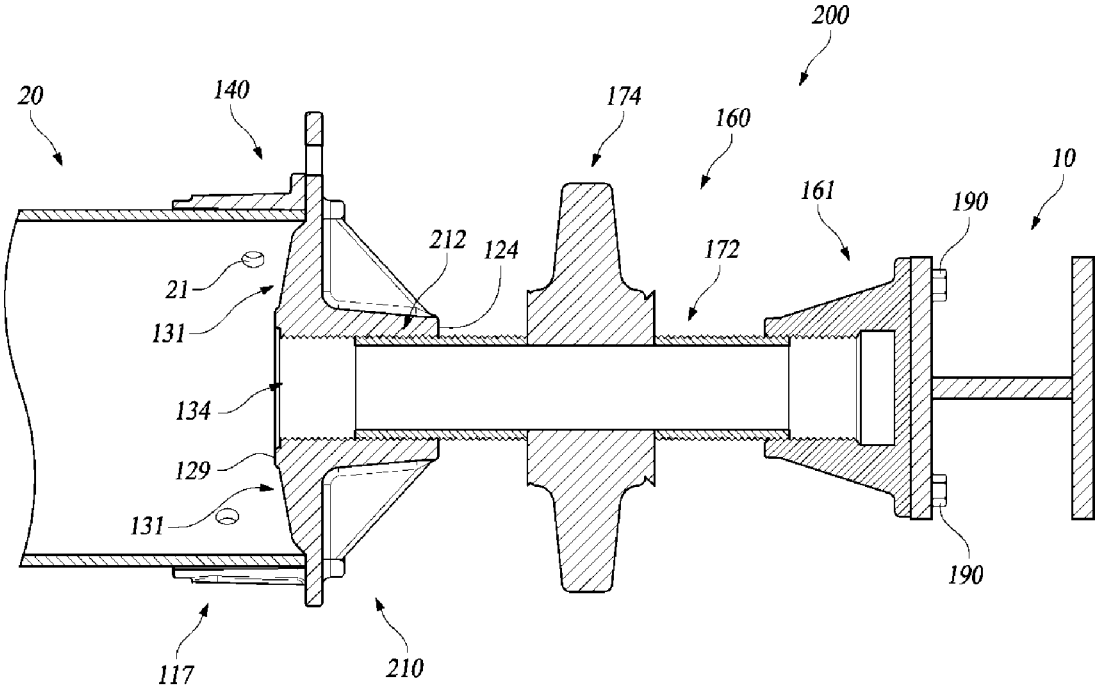
FIG. 10 is a cross-sectional view illustrating an installation state of a strut connector according to still another embodiment of the present invention.

First, a strut connector 200 illustrated in FIG. 10 includes a connector base 210, a cover band 140, a strut fastener 185 and a connection jack 160. The connector base 210 is coupled to an end of a strut 20, the cover band 140 is coupled to the connector base 210 so as to fix an end periphery of the strut 20 along with the connector base 210, the strut fastener 185 serves to fasten the connector base 210 and the cover band 140 to the strut 20, and the connection jack 160 is coupled to the connector base 210 so as to adjust the distance between a wale 10 and the connector base 210. Such a strut connector 200 is different from the above-described strut connector 100 in that the structure of the connector base 210 is slightly modified, and the cover band 140, the strut fastener 185 and the connection jack 160 have the same structures as described above.

The connector base 210 includes a base body 111, a support band 117 provided at the bottom edge of the base body 111 so as to protrude from one surface of the base body 111, a base connection boss 124 protruding from the other surface of the base body 111, a base reinforcement boss 129 protruding from the one surface of the base body 111 to a smaller protruding height than the support band 117, a plurality of base inner reinforcement ribs 131 arranged on the circumference of the base reinforcement boss 129, and a base through-hole 134 formed through the base body 111, the base connection boss 124 and the base reinforcement boss 129. The base through-hole 134 has a base screw portion 212 formed on the inside thereof. A connection jack screw 172 of the connection jack 160 may be screwed to the base screw portion 212. The base screw portion 212 is formed across the base body 111, the base connection boss 124 and the base reinforcement boss 129.

Such a strut connector 200 has a structure in which the length of the base screw portion 212 formed on the connector base 210 is increased more than in the above-described strut connector 100, thereby increasing the coupling force between the connector base 210 and the connection jack 160, and more stably supporting the strut 20.

Figure 11:
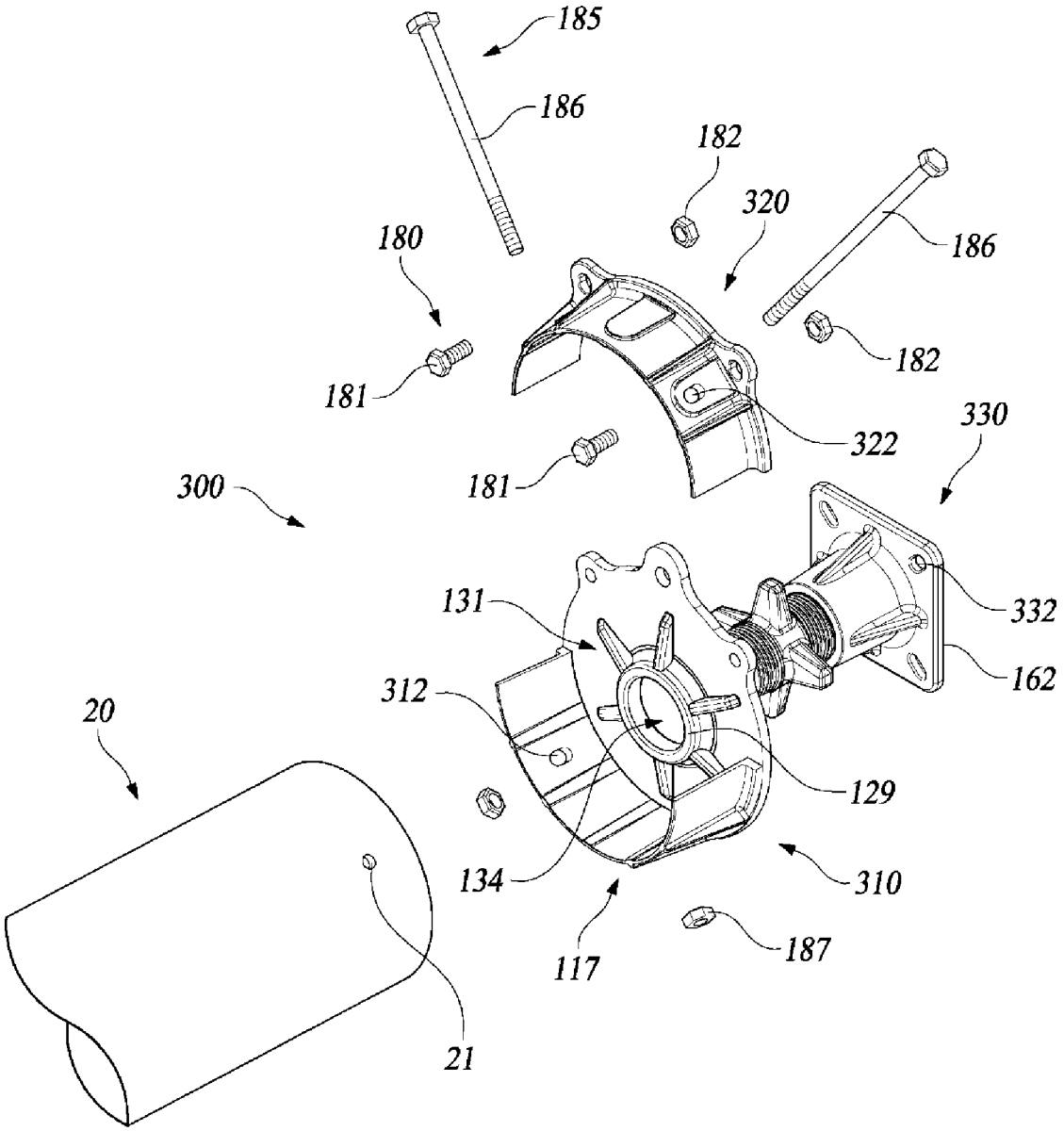
FIG. 11 is a partially exploded view of a strut connector according to yet another embodiment of the present invention.
Figure 12:
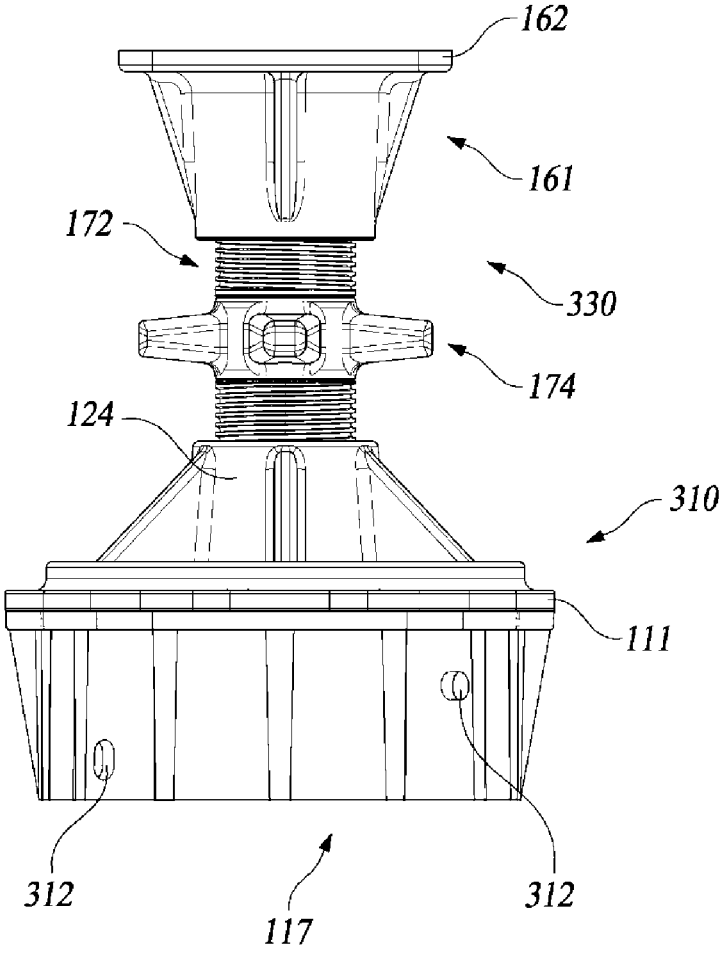
FIG. 12 is a plan view illustrating that a connector base and a connection jack of the strut connector illustrated in FIG. 11 are assembled.
Figure 13:
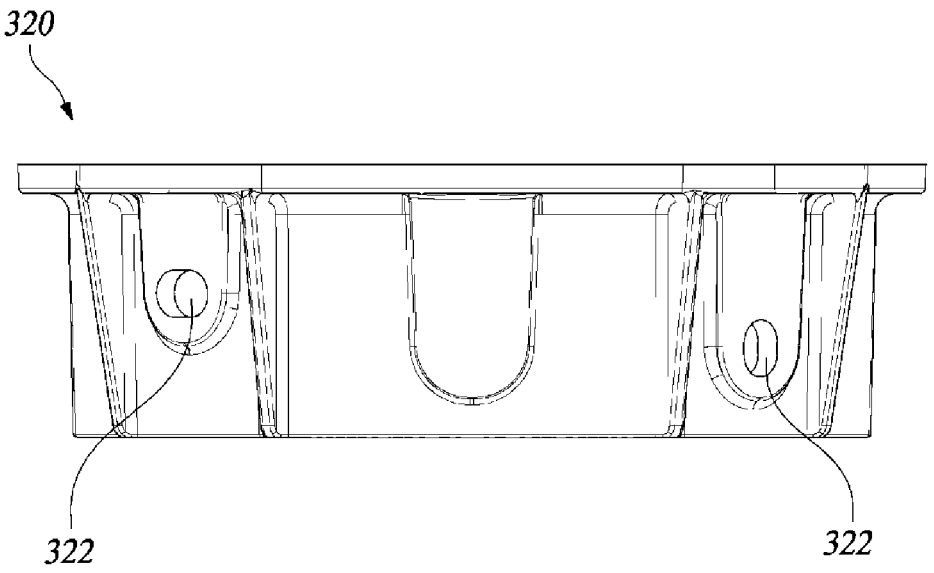
FIG. 13 is a plan view illustrating a cover band of the strut connector illustrated in FIG. 11.

FIG. 11 is a partially exploded view of a strut connector according to yet another embodiment of the present invention, FIG. 12 is a plan view illustrating that a connector base and a connection jack of the strut connector illustrated in FIG. 11 are assembled, and FIG. 13 is a plan view illustrating a cover band of the strut connector illustrated in FIG. 11.

As illustrated in the drawings, a strut connector 300 according to yet another embodiment of the present invention includes a connector base 310, a cover band 320, a strut fastener 185 and a connection jack 330. The connector base 310 is coupled to an end of a strut 20, the cover band 320 is coupled to the connector base 310 so as to fix an end periphery of the strut 20 along with the connector base 310, the strut fastener 185 serves to fasten the connector base 310 and the cover band 320 to the strut 20, and the connection jack 330 is coupled to the connector base 310 so as to adjust the distance between a wale 10 and the connector base 310. The strut fastener 185 has the same structure as described above.

As illustrated in FIGS. 11 and 12, the connector base 310 includes a base body 111, a support band 117 provided at the bottom edge of the base body 111 so as to protrude from one surface of the base body 111, a base connection boss 124 protruding from the other surface of the base body 111, a base reinforcement boss 129 protruding from the one surface of the base body 111 to a smaller protruding height than the support band 117, a plurality of base inner reinforcement ribs 131 arranged on the circumference of the base reinforcement boss 129, and a base through-hole 134 formed through the base body 111, the base connection boss 124 and the base reinforcement boss 129.

The support band 117 has a plurality of support band through-holes 312 corresponding to strut coupling holes 21 formed in the strut 20.

The support band through-hole 312 is formed in a long groove shape extended in one direction, and has a larger size than the strut coupling hole 21. As such, when the size of the support band through-hole 312 is larger than the size of the strut coupling hole 21, the strut coupling hole 21 may be easily matched with the support band through-hole 312 in case that the end periphery of the strut 20 is placed on the support band 117. The strut coupling holes 21 may be formed at slightly different positions for each strut 20 due to a manufacturing error or the like, and the support band through-holes 312 may be formed at slightly different positions for each manufactured connector base 310 for the same reason. Therefore, when the support band through-hole 312 has a larger size than the strut coupling hole 21, it is possible to match the strut coupling hole 21 with the support band through-hole 312 by adjusting the position of the strut 20, even though the strut 20 or the connector base 310 has a manufacturing error.

The two support band through-holes 312 formed in the support band 117 are extended in different directions. In other words, one of the two support band through-holes 312 is extended in the longitudinal direction of the strut 20 coupled to the support band 117, and the other of the two support band through-holes 312 is extended in a direction perpendicular to the longitudinal direction of the strut 20. Such an arrangement of the support band through-holes 312 makes it easier to match the strut coupling hole 21 with the support band through-hole 312 by adjusting the position of the strut 20, when the strut 20 or the connector base 310 has a manufacturing error. As a result, such an arrangement of the support band through-holes 312 facilitates the work of fastening a fastening member 186 to the support band 117 and the strut 20.

Referring to FIGS. 11 and 13, the cover band 320 is separably coupled to the connector base 310 so as to cover a part of the outer circumferential surface of the strut 20 coupled to the connector base 310. The cover band 320 includes a cover band body 141 having a cover band arc portion 142 corresponding to the outer circumferential surface of the strut 20. The cover band body 141 has a plurality of cover band through-holes 322 corresponding to the strut coupling holes 21 formed in the strut 20. The cover band body 141 has two cover band through-holes 322 which are spaced apart from each other so as to correspond to two strut coupling holes 21 located at a relatively high level, among the four strut coupling holes 21 formed in the strut 20. When the cover band 140 is coupled to the end periphery of the strut 20, each of the cover band through-holes 322 faces the corresponding strut coupling hole 21.

The cover band through-hole 322 is formed in a long groove shape extended in one direction, like the support band through-hole 312 of the support band 117, and has a larger size than the strut coupling hole 21. As such, when the cover band through-hole 322 has a larger size than the strut coupling hole 21, it is possible to match the cover band through-hole 322 with the support band through-hole 312 by adjusting the position of the cover band 320, even though the strut 20 or the cover band 320 has a manufacturing error.

The two cover band through-holes 322 formed in the cover band 320 are extended in different directions. Like the support band through-holes 312 of the support band 117, one of the two cover band through-holes 322 is extended in the longitudinal direction of the strut 20 to which the cover band 320 is coupled, and the other of the two cover band through-holes 322 is extended in a direction crossing the longitudinal direction of the strut 20. When the cover band 320 is coupled to the connector base 310, the support band through-holes 312 and the cover band through-holes 322 which are respectively arranged to face each other are extended in the same directions. In other words, when the cover band 320 is coupled to the connector base 310, the support band through-hole 312 and the cover band through-hole 322 which are extended in the longitudinal direction of the strut 20 face each other, and the support band through-hole 312 and the cover band through-hole 322 which are extended in the direction perpendicular to the longitudinal direction of the strut 20 face each other. Such an arrangement of the cover band through-holes 322 makes it easier to match the cover band through-holes 322 with the support band through-holes 312 by adjusting the position of the cover band 320. As a result, such an arrangement facilitates the work of fastening the fastening member 186 to the cover band 320 and the strut 20.

FIG. 11 illustrates that the two support band through-holes 312 cross each other at a right angle, and the two cover band through-holes 322 cross each other at a right angle. However, the arrangement directions of the support band through-holes 312 or the cover band through-holes 322 may be changed in various manners. That is, the two support band through-holes 312 may be arranged to cross each other at an angle different from the right angle, and the two cover band through-holes 322 may also be arranged to cross each other at an angle different from the right angle.

The connection jack 330 is fixed to the wale 10 and connects the connector base 310 to the wale 10 such that the distance therebetween is adjustable. The connection jack 330 includes a connection jack body 161 coupled to the wale 10 and a connection jack screw 172 screwed to the connector base 310 and the connection jack body 161. The connection jack body 161 includes a connection jack bracket 162 fixed to the wale 10 and a connection jack boss 165 protruding from one surface of the connection jack bracket 162. The connection jack bracket 162 has a plurality of connection jack body through-holes 332. A fixing member 190 for fixing the connection jack body 161 may be inserted into each of the connection jack body through-holes 332.

The connection jack body through-hole 332 is formed in a long groove shape extended in a direction crossing the direction in which the connector base 310 is pressurized by the connection jack 330. FIG. 11 illustrates that the four connection jack body through-holes 332 are symmetrically arranged in the top-to-bottom and side-to-side directions. However, the number or positions of the connection jack body through-holes 332 may be changed in various manners.

As such, when the connection jack body through-holes 332 are formed in a long groove shape, the coupling position of the connection jack 330 on the wale 10 may be easily adjusted. Although the connection jack 330 has a manufacturing error, the position of the connection jack 330 may be adjusted to make it more easier to install the connection jack 330 onto the wale 10.

Figure 14:
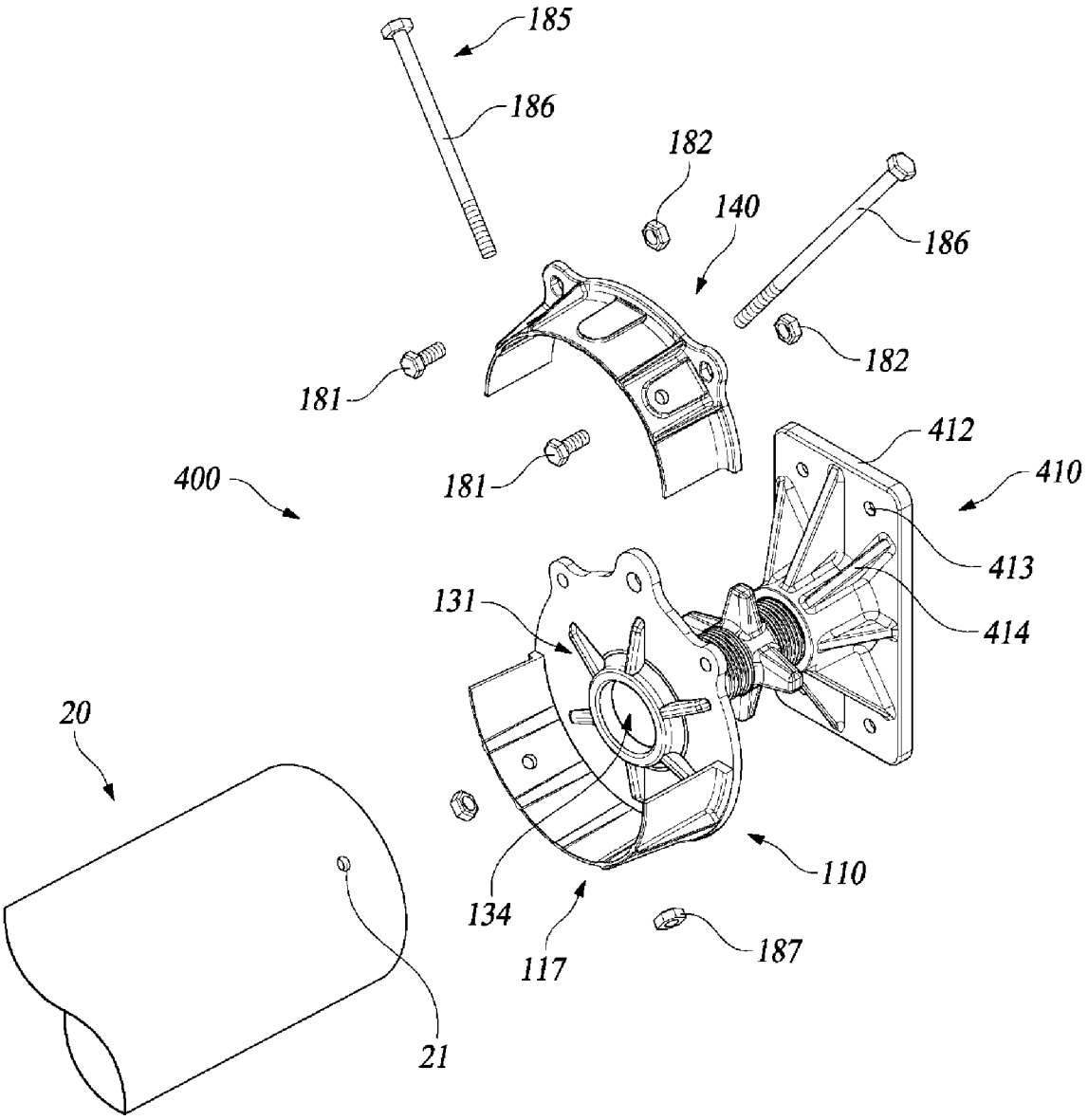
FIG. 14 is a partially exploded view of a strut connector according to still yet another embodiment of the present invention.
Figure 15:
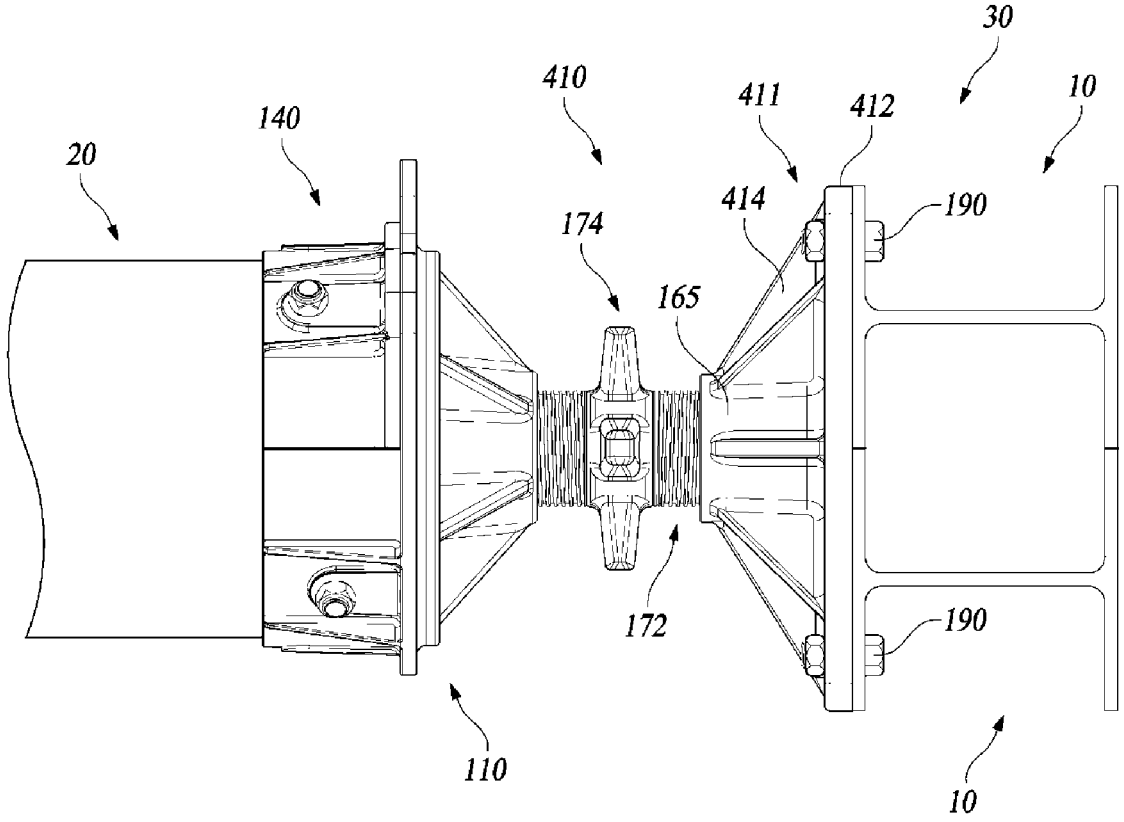
FIG. 15 is a side view illustrating an installation state of the strut connector illustrated in FIG. 14.

FIG. 14 is a partially exploded view of a strut connector according to still yet another embodiment of the present invention, and FIG. 15 is a side view illustrating an installation state of the strut connector illustrated in FIG. 14.

A strut connector 400 illustrated in FIGS. 14 and 15 includes a connector base 110, a cover band 140, a strut fastener 185 and a connection jack 410. The connector base 110 is coupled to an end of a strut 20, the cover band 140 is coupled to the connector base 110 so as to fix an end periphery of the strut 20 along with the connector base 110, the strut fastener 185 serves to fasten the connector base 110 and the cover band 140 to the strut 20, and the connection jack 410 is coupled to the connector base 110 so as to adjust the distance between a wale 10 and the connector base 110. The strut connector 400 according to the present embodiment is different from the strut connector 100 illustrated in FIGS. 1 to 8 in that the structure of the connection jack 410 is slightly modified, and the other components have the same structures as described above.

The connection jack 410 is fixed to the wale 10 and connects the connector base 110 to the wale 10 such that the distance therebetween is adjustable. The connection jack 410 includes a connection jack body 411 coupled to the wale 10 and a connection jack screw 172 screwed to the connector base 110 and the connection jack body 411. The connection jack body 411 includes a connection jack bracket 412 fixed to the wale 10 and a connection jack boss 165 protruding from one surface of the connection jack bracket 412.

The connection jack bracket 412 has a plurality of connection jack body through-holes 413. A fixing member 190 for fixing the connection jack body 411 may be inserted into each of the connection jack body through-holes 413. The connection jack bracket 412 has a plurality of connection jack body reinforcement ribs 414 arranged on one surface thereof and spaced apart from each other along the outer circumferential surface of the connection jack boss 165. The connection jack body reinforcement ribs 414 may protrude from the connection jack bracket 412 so as to be connected to the connection jack boss 165, thereby increasing the entire strength of the connection jack body 411.

The connection jack bracket 412 has a length corresponding to the top-to-bottom length of a wale assembly 30 so as to be fixed to the wale assembly 30 in which two wales 10 are connected in parallel to each other in the top-to-bottom direction by the plurality of fixing members 190 while abutting on each other.

On an earth retaining work site, the case in which two wales 10 are connected in parallel to each other in the top-to-bottom direction in order to support the entire earth retaining wall, as illustrated in FIG. 15, often occurs, if necessary. The strut connector 400 according to the present embodiment has a structure in which the connection jack bracket 412 coupled to the wales 10 is elongated in the top-to-bottom direction. Thus, the strut connector 400 may be stably fixed to the wale assembly 30 in which the two wales 10 are connected in parallel to each other in the top-to-bottom direction. Therefore, it is possible to omit the inconvenient work of vertically erecting a separate connection member such as an H beam and fixing the erected connection member to the wale assembly 30 in order to couple the strut connector 400 to the wale assembly 30, and to directly fix the strut connector 400 to the wale assembly 30, thereby facilitating the use of the strut connector 400 and shortening the work time.

Figure 16:
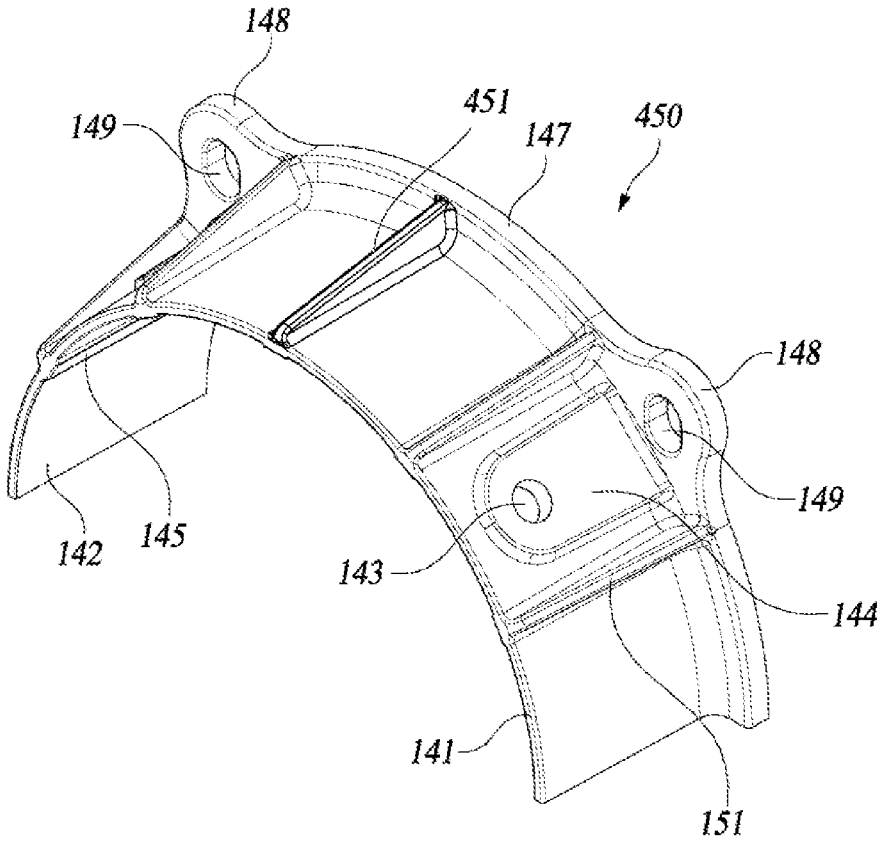
FIG. 16 is a perspective view illustrating a modified example of the cover band included in the strut connector according to the present invention.

A cover band 450 illustrated in FIG. 16 includes a cover band body 141 having a cover band arc portion 142 corresponding to the outer circumferential surface of the strut 20. The cover band arc portion 142 has a plurality of cover band through-holes 143 and a plurality of cover band pressurizing protrusions 145. The cover band body 141 has a cover band flange 147 provided at an edge thereof, the cover band flange 147 has a pair of cover band flange protrusions 148 provided at an outer edge thereof so as to protrude to the outside, and each of the cover band flange protrusions 148 has a cover band coupling hole 149.

The cover band body 141 has a plurality of cover band reinforcement ribs 151 and a cover band center reinforcement rib 451, which are arranged on the outer surface thereof and spaced apart from each other along the outer circumferential surface thereof. The cover band center reinforcement rib 451 is located in the center of the cover band body 141, and the plurality of cover band reinforcement ribs 151 are located symmetrically with respect to the cover band center reinforcement rib 451.

Such a cover band 450 has a structure in which the cover band center reinforcement rib 451 protrudes from the center of the cover band body 141, and the plurality of cover band reinforcement ribs 151 are located symmetrically with respect to the cover band center reinforcement rib 451, thereby effectively increasing the entire strength of the cover band body 141 and the cover band 140, and preventing the deformation of the cover band 140.

So far, the present invention has been described with reference to the preferred embodiments, but the scope of the present invention is not limited to the above-described and illustrated embodiments.

For example, the connector base may be changed to various other structures including the support band and the support band through-holes, in addition to the illustrated structures, and the cover band may also be changed to various other structures including the cover band arc portion and the cover band through-holes, in addition to the illustrated structures.

Furthermore, although FIG. 14 illustrates that the strut fastener 185 includes two fastening members 186, the number of the fastening members 186 may be changed in various manners depending on the number of the strut coupling holes 21 formed in the strut 20.

Furthermore, although not illustrated in the drawings, a pad made of an elastic material such as rubber may be provided on the inside of the support band of the connector base or the inside of the cover band. The pad located on the connector base may block a gap between the strut and the support band, and prevent a push between the strut and the support band, thereby increasing the coupling force therebetween. Furthermore, the pad located on the cover band may block the gap between the strut and the cover band, and prevent a push between the strut and the cover band, thereby increasing the coupling force therebetween.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

The invention claimed is:

1. A strut connector which is coupled to an end of a strut for supporting a wale coupled to an earth retaining wall, and connects the wale and the strut, the strut connector comprising:

a connector base comprising a base body; a support band having a support band arc portion corresponding to the outer circumferential surface of the strut so as to support an end periphery of the strut, and provided at an edge of the base body so as to protrude from one surface of the base body; a base reinforcement boss provided on a central portion of the base body so as to protrude from the one surface of the base body to a smaller height than the support band; a base connection boss protruding from the other surface of the base body in the opposite direction of the protruding direction of the support band; a base through-hole formed through the base body, the base reinforcement boss and the base connection boss; and a base screw portion formed on the inside of the base through-hole;

a cover band comprising a cover band body having a cover band arc portion corresponding to the outer circumferential surface of the strut, and separably coupled to the connector base such that the cover band body covers the outer circumferential surface of the strut placed on the support band;

a cover band fixer configured to fix the cover band to the connector base; and a connection jack comprising: a connection jack body having a connection jack bracket coupled to the wale and a connection jack boss protruding from one surface of the connection jack bracket; a connection jack body coupling hole formed in the connection jack boss; a connection jack body screw portion formed on the inside of the connection jack body coupling hole; a connection jack screw screwed to the base screw portion and the connection jack body screw portion and configured to connect the connector base and the connection jack body such that the distance therebetween is adjustable, and a connection jack lever provided on one side of the connection jack screw so as to protrude to the outside, wherein the connection jack screw is able to enter the strut placed on the support band through the base through-hole.

2. The strut connector according to claim 1, wherein the connector base comprises a plurality of base inner reinforcement ribs protruding from the one surface of the base body and radially arranged on the circumference of the base reinforcement boss.

3. The strut connector according to claim 2, wherein the base inner reinforcement rib has a length which is set to such an extent that an end thereof abuts on the inner circumferential surface of the strut placed on the support band.

4. The strut connector according to claim 3, wherein the base inner reinforcement rib comprises an inclined portion which is provided at the end periphery thereof and formed in such a shape that the protruding height thereof from the one surface of the base body decreases in a direction away from the base reinforcement boss.

5. The strut connector according to claim 2, wherein the plurality of base inner reinforcement ribs are arranged at regular angle intervals along the circumference of the base reinforcement boss.

6. The strut connector according to claim 1, wherein the connection jack bracket comprises a plurality of connection jack body through-holes into which a plurality of fixing members fixed to the wale are inserted, and has a length corresponding to the top-to-bottom length of a wale assembly so as to be fixed to the wale assembly in which two wales are connected in parallel to each other in a top-to-bottom direction by the plurality of fixing members while abutting on each other.

7. The strut connector according to claim 1, wherein the support band comprises a plurality of support band through-holes corresponding to a plurality of strut coupling holes which are arranged on the outer circumferential surface of the strut so as to be spaced apart from each other in a radial direction of the strut, and the cover band body comprises a plurality of cover band through-holes corresponding to the plurality of strut coupling holes, wherein the strut connector further comprises a plurality of fastening members each inserted into the corresponding strut coupling hole, the corresponding support band through-hole and the corresponding cover band through-hole so as to fasten the strut to the connector base and the cover band.

8. The strut connector according to claim 7, wherein the cover band through-holes are formed in a long groove shape extended in one direction, and at least one of the cover band through-holes is extended in a direction crossing the direction in which another of the cover band through-holes is extended, wherein the support band through-holes are formed in a long groove shape extended in one direction so as to correspond to the respective cover band through-holes, and at least one of the support band through-holes is extended in a direction crossing the direction in which another of the support band through-holes is extended.

9. The strut connector according to claim 1, wherein the cover band comprises a plurality of cover band reinforcement ribs and one cover band center reinforcement rib, which protrude from the outer surface of the cover band body, wherein the plurality of cover band reinforcement ribs and the cover band center reinforcement rib are arranged along the outer circumferential surface of the cover band body so as to spaced apart from each other, the cover band center reinforcement rib is located in the center of the cover band body, and the plurality of cover band reinforcement ribs are symmetrically arranged with respect to the cover band center reinforcement rib.

* * * * *